US006744362B2

(12) United States Patent
Carlson

(10) Patent No.: US 6,744,362 B2
(45) Date of Patent: Jun. 1, 2004

(54) CONSUMABLE REPLACEMENT BY MOBILE INPUT/OUTPUT BINS

(75) Inventor: Gerard J. Carlson, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 195 days.

(21) Appl. No.: 10/057,638

(22) Filed: Jan. 24, 2002

(65) Prior Publication Data

US 2003/0137686 A1 Jul. 24, 2003

(51) Int. Cl.[7] ..... G08B 23/00

(52) U.S. Cl. ..... 340/500; 340/500; 340/679; 340/612; 340/613; 340/988; 235/384

(58) Field of Search ..... 340/500, 679, 340/612, 613, 988; 235/384

(56) References Cited

U.S. PATENT DOCUMENTS

| | | | | |
|---|---|---|---|---|
| 4,007,843 A | | 2/1977 | Lubbers et al. | 214/16.4 B |
| 4,688,678 A | | 8/1987 | Zue et al. | |
| 4,894,908 A | | 1/1990 | Haba, Jr. et al. | 29/711 |
| 5,342,034 A | | 8/1994 | Mandel et al. | |
| 5,431,600 A | * | 7/1995 | Murata et al. | 454/187 |
| 5,525,031 A | | 6/1996 | Fox | 414/789.7 |
| 5,629,672 A | | 5/1997 | Brown et al. | |
| 5,793,298 A | | 8/1998 | Matsuura | |
| 5,803,704 A | | 9/1998 | Lazzarotti | 414/793.4 |
| 5,804,804 A | | 9/1998 | Fukatsu et al. | |
| 5,896,297 A | | 4/1999 | Valerino, Sr. | 364/478.01 |
| 5,961,571 A | | 10/1999 | Gorr et al. | 701/207 |
| 5,990,437 A | | 11/1999 | Coutant et al. | |
| 6,006,237 A | | 12/1999 | Frisbey | 707/104 |
| 6,014,649 A | | 1/2000 | Kobayashi et al. | |
| 6,060,992 A | | 5/2000 | Huang et al. | 340/674 |
| 6,168,145 B1 | | 1/2001 | Tanaka et al. | |
| 6,202,004 B1 | | 3/2001 | Valerino, Sr. | 700/218 |
| 6,216,053 B1 | | 4/2001 | Cureton et al. | 700/104 |
| 6,459,061 B1 | | 10/2002 | Kugle et al. | |
| 6,460,681 B1 | | 10/2002 | Coutant et al. | |
| 6,498,454 B1 | | 12/2002 | Pinlam et al. | |

* cited by examiner

*Primary Examiner*—Daryl Pope
(74) *Attorney, Agent, or Firm*—James R. McDaniel

(57) ABSTRACT

This invention relates to self-propelled, mobile input/output bins (MIOB). Such structures of the type, generally, allow the MIOB to replenish the consumable handling device. For example, the MIOB can be used to replenish the paper in a printer and/or printing device.

20 Claims, 2 Drawing Sheets

CONSUMABLE REPLACEMENT BY MOBILE INPUT/OUTPUT BINS

FIELD OF THE INVENTION

This invention relates to self-propelled, mobile input/output bins (MIOB). Such structures of this type, generally, allow the MIOB to replenish the consumable handling device. For example, the MIOB can be used to replenish the paper in a printer and/or printing device.

DESCRIPTION OF THE RELATED ART

As printer manufacturers move into the larger, higher speed pages per minute market, the printers will need more attention from the data center or other technical support personnel. For example, it is common that high-speed printers can consume a ream of paper every 10 minutes. Consequently, even with a 2500 page input bin, this high-speed printer will need paper replenishment in less than an hour. To compound this even further, the output bin is an even larger problem because it may need to be emptied several times an hour. Therefore, a more advantageous system, then, would be presented if a self-propelled, mobile input/output bin (MIOB) could be utilized to service these higher volume printers.

It is known, in the printing art, to employ an automated print job distribution system for a shared user centralized printer. Exemplary of such prior art is U.S. Pat. No. 5,525,031 ('031) to E. D. Fox, entitled "Automated Print Jobs Distribution System for Shared User Centralized Printer." While the '031 reference teaches the use of a mobile, vehicular mail boxing module that interacts with a printer in order to collect and distribute print jobs, it does not teach, suggest or even appreciate the use of a MIOB for consumable replacement.

It is also known, in the printing art, to employ a vast variety of notification systems on a printer for notifying the system administrator and/or other technical support personnel when the printer needs to be serviced. For example, if a printer is low on paper, the user may merely touch a button or some other type of notification device and the system administrator and/or other technical support personnel are alerted that the printer is out of paper. Someone is then sent to install paper in that printer. However, this results in printer downtime while the user waits for the printer to be serviced. Clearly, this is a labor-intensive activity that could be reduced through the use of a self-propelled MIOB that can be sent to the printer in order to replenish the paper supply in that printer when the printer begins to get low on paper.

It is apparent from the above that there exists a need in the art for a consumable replacement system for a printer or other such consumable handling devices, which at least equals the consumable replacement systems of the prior art, but which at the same time employs the use of a self-propelled MIOB. It is a purpose of this invention to fulfill this and other needs in the art in a manner more apparent to the skilled artisan once given the following disclosure.

SUMMARY OF THE INVENTION

Generally speaking, this invention fulfills these needs by providing a method for alleviating an undesirable consumable condition, comprising the steps of: detecting an undesirable consumable condition at a consumable handling device; interacting between the consumable handling device and a self-propelled, mobile input/output bin; and alleviating the undesired condition through the use of the bin.

In certain preferred embodiments, the consumable handling device can be, but is not limited to, a printer, a printing device, a media handling device or the like. Also, the undesired consumable condition can be, but is not limited to, low toner supply, low media supply, low ink supply, full output bin, full waste toner reservoir, media jam or the like.

In another further preferred embodiment, the self-propelled, mobile input/output bin (MIOB) provides a fast, efficient means to alleviate undesired consumable conditions at consumable handling devices without having to involve the system administrator and/or other technical support personnel.

The preferred method, according to this invention, offers the following advantages: ease of consumable replacement/replenishment; improved economy; and reduced downtime. In fact, in many of the preferred embodiments, these factors of ease of consumable replacement/replenishment and reduced downtime are optimized to an extent that is considerably higher than heretofore achieved in prior, known consumable replacement/replenishment systems.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
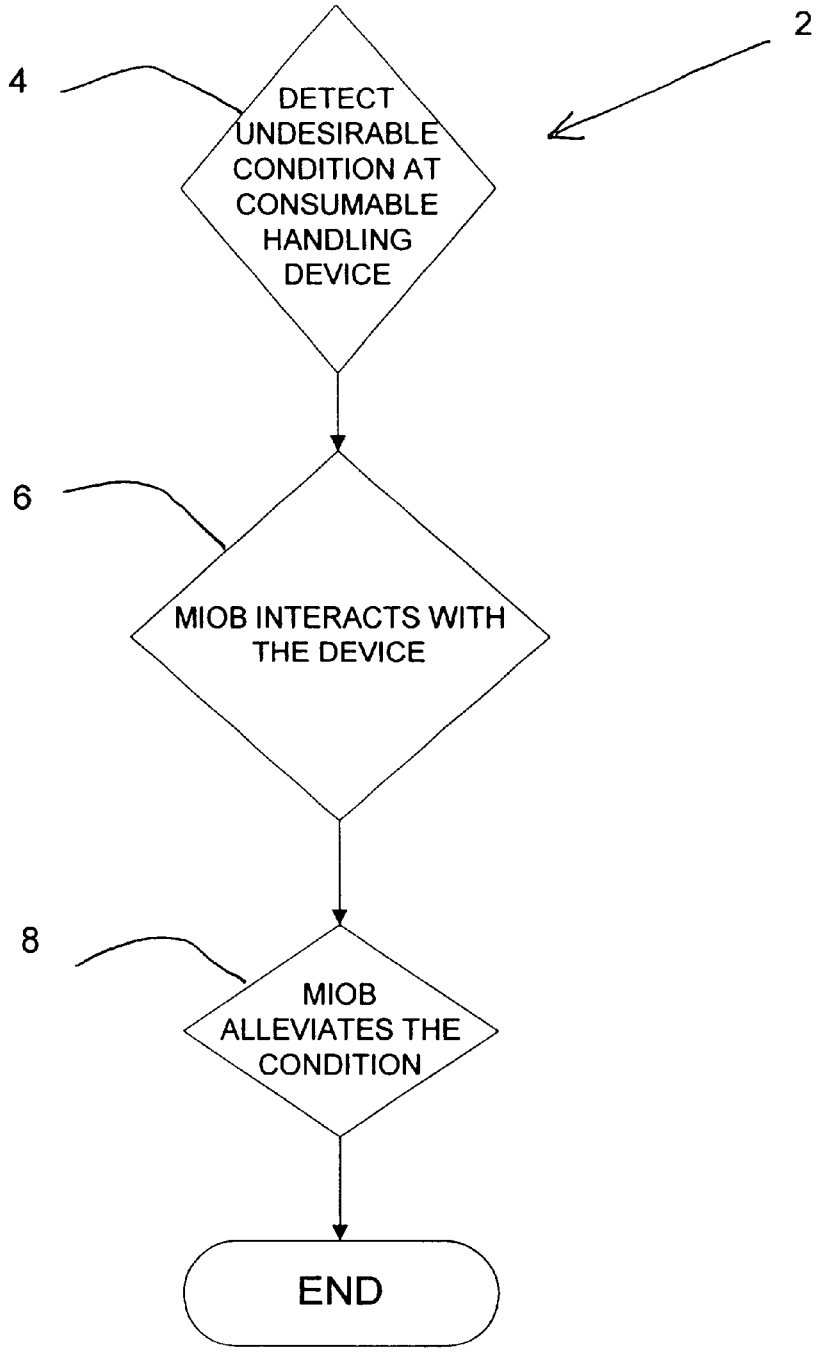
FIG. 1 is a flowchart that illustrates a method for consumable replacement/replenishment through the use of a self-propelled, mobile input/output bin (MIOB)

With reference to FIG. 1, there is illustrated one preferred embodiment for use of the concepts of this invention. Method 2 includes, for example, the steps of detecting an undesirable condition at the consumable handling device (step 4), interacting between the mobile, input/output bin (MIOB) (step 6), and allowing the MIOB to alleviate the undesirable condition (step 8). It is to be understood that a list of undesirable conditions may include, but is not limited to, low supply of toner, low supply of ink, low supply of media, media jam, full output bins, full waste toner reservoir and/or or the like. It is also to be understood that a typical consumable handling device can be, but is not limited to, a printer, a printing device, a media handling device and/or the like. Finally, it is to be understood that the phrase "printing device" can be, but is not limited to, facsimile machines, scanners, plotters or the like.

With respect to the MIOB, it is envisioned that this device be a lightweight, autonomous, wheeled, cart-type robot that conventionally operates off of conventional, rechargeable batteries. During periods of use, the MIOB finds a docking station to conventionally recharge and possibly conventionally plug into a network link to exchange data with other MIOBs, printers, mailboxes or servers. The MIOB of the present invention is similar in some respects to the mailroom robots discussed above. However, a significant difference is that the MIOB of the present invention is designed to service all types of consumable handling devices, not just printers.

It is to be understood that the MIOB can be outfitted so as to service various consumable handling devices. For example, the MIOB can be equipped with a conventional ink replenishment means. Another MIOB can be fitted with a conventional output bin media removal device. Still another MIOB may be conventionally set up to remove media jams located within the consumable handling device. The media handling device signals that an undesirable condition exists or is about to exist, such as low ink supply, and the MIOB equipped with the ink replenishment means is sent to the distressed media handling device. In this manner, when the printer does run out of ink, for example, the MIOB is right there to alleviate the problem.

A further advantageous aspect of the present invention will now be described with respect to the passive/active nature of the present invention. For example, if a printer runs out of toner, the printer can conventionally contact a data center (not shown) and inform the data center that that particular printer is out of toner. The data center then contacts a MIOB which houses the type and amount of toner needed for the printer and provides the MIOB with information as to the location of the printer that is out of toner. The MIOB proceeds to that printer and conventionally installs the toner. While the toner example has been used, it is to be understood that the MIOB could also be used to replace/replenish media, remove jammed media, empty full output bins, empty full waste toner reservoirs or the like.

It is to be understood that various conventional communication techniques between the consumable handling device, data center, and MIOB can be employed. For example, conventional wireless techniques can be employed. Also, a variety of hardwired communication systems can be used.

Figure 2:
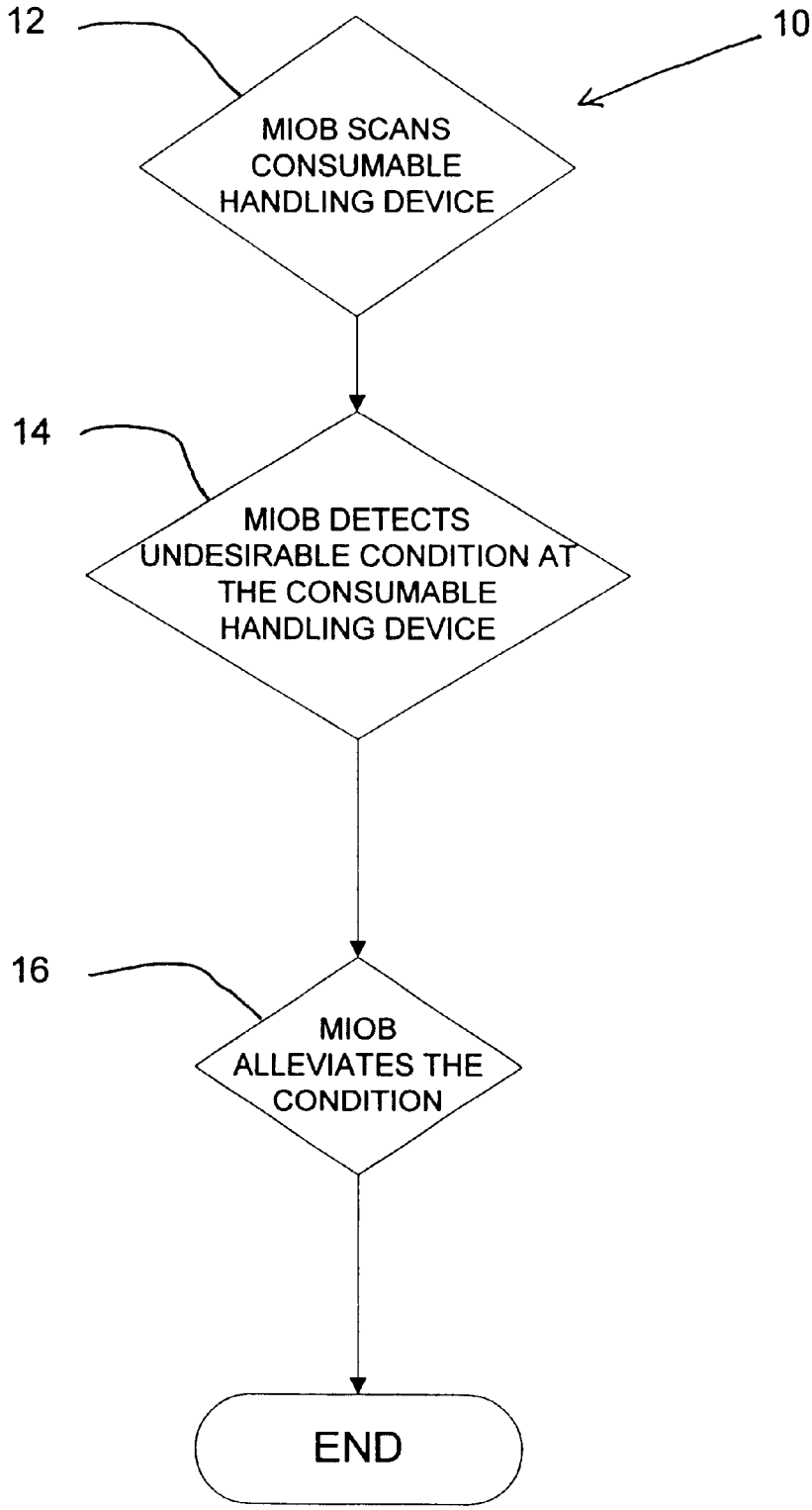
FIG. 2 is a flowchart that illustrates an active method for consumable replacement/replenishment through the use of a self-propelled, mobile input/output bin (MIOB).

The MIOB can also be utilized in an active manner (FIG. 2). For example, a MIOB that is solely dedicated to replenishing the paper supply of various printers and/or printing devices constantly moves about and conventionally scans/monitors the various printers and/or printing devices in order to determine if the printer and/or printing device is out of paper (step 12). If the printer and/or printing device is out of paper it may, for example, conventionally emit a signal that can be detected by the MIOB (step 14). The MIOB then conventionally interacts with the printer and/or printing device in order to replenish the paper supply (step 16). It is to be understood that variously equipped MIOBs could be used to roam a particular area and scan/monitor the various consumable handling devices in order to determine if an undesirable condition exists in any of the consumable handling devices. In fact, such active MIOBs could be utilized in off hours and/or during the weekends in order to service the consumable handling devices without adversely affecting the workforce.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for consumable replacement, comprising the steps of:

detecting an undesirable consumable replacement condition at a consumable handling device;

interacting between said consumable handling device and a self-propelled, mobile input/output bin; and replacing a consumable at said consumable handling device through the use of said bin.

2. The method, as in claim 1, wherein said detecting step is further comprised of the step of:

notifying a data center of said undesirable consumable replacement condition.

3. The method, as in claim 1, wherein said detecting step is further comprised of the step of:

scanning/monitoring said consumable handling device to detect said undesirable consumable replacement condition.

4. The method, as in claim 1, wherein said consumable handling device is further comprised of:

a printer.

5. The method, as in claim 1, wherein said consumable handling device is further comprised of:

a printing device.

6. The method, as in claim 1, wherein said method is further comprised of the step of:

outfitting said bin so that said bin alleviates said undesirable consumable replacement condition.

7. The method, as in claim 1, wherein said detecting step is further comprised of the step of:

wirelessly detecting said consumable replacement condition.

8. The method, as in claim 1, wherein said interacting step is further comprised of the step of:

wirelessly interacting between said consumable handling device and said bin.

9. A method for passive consumable replacement, comprising the steps of:

detecting an undesirable consumable replacement condition at a consumable handling device;

contacting a self-propelled, mobile input/output bin; and sending said bin to said consumable handling device in order to replace a consumable at said consumable handling device.

10. The method, as in claim 9, wherein said consumable handling device is further comprised of:

a printer.

11. The method, as in claim 9, wherein said consumable handling device is further comprised of:

a printing device.

12. The method, as in claim 9, wherein said method is further comprised of the step of:

outfitting said bin so that said bin alleviates said undesirable consumable replacement condition.

13. The method, as in claim 9, wherein said detecting step is further comprised of the step of:

wirelessly detecting said consumable replacement condition.

14. The method, as in claim 9, wherein said interacting step is further comprised of the step of:

wirelessly contacting said bin.

15. A method for actively alleviating an undesirable consumable condition, comprising the steps of:

scanning/monitoring a consumable handling device by a self-propelled, mobile input/output bin;

detecting an undesirable consumable condition at said consumable handling device by said bin; and alleviating said undesirable condition through the use of said bin.

16. The method, as in claim 15, wherein said consumable handling device is further comprised of:

a printer.

17. The method, as in claim 15, wherein said consumable handling device is further comprised of:

a printing device.

18. The method, as in claim 15, wherein said method is further comprised of the step of:

outfitting said bin so that said bin alleviates said undesirable condition.

19. The method, as in claim 15, wherein said detecting step is further comprised of the step of:

wirelessly detecting said condition.

20. The method, as in claim 15, wherein said scanning/monitoring step is further comprised of the step of:

wirelessly contacting said consumable handling device.

* * * * *